US005919053A

United States Patent [19]

Tsuji et al.

[11] Patent Number: 5,919,053

[45] Date of Patent: Jul. 6, 1999

[54] CONNECTOR ENGAGING STRUCTURE

[75] Inventors: Masanori Tsuji; Osamu Sugiyama, both of Shizuoka-ken; Tsuneyuki Takahashi, Kanagawa-ken, all of Japan

[73] Assignee: Yazaki Corporation, Tokyo, Japan

[21] Appl. No.: 09/092,265

[22] Filed: Jun. 5, 1998

[30] Foreign Application Priority Data

Jun. 6, 1997 [JP] Japan ..... 9-149372

[51] Int. Cl.[6] ..... H01R 13/62

[52] U.S. Cl. ..... 439/157; 439/347

[58] Field of Search ..... 439/157, 347, 439/152, 153, 342, 372

[56] References Cited

U.S. PATENT DOCUMENTS

| | | | |
|---|---|---|---|
| 5,326,279 | 7/1994 | Sumida | 439/157 |
| 5,569,040 | 10/1996 | Sumida | 439/157 |
| 5,681,175 | 10/1997 | Busse | 439/157 |

FOREIGN PATENT DOCUMENTS

| | | |
|---|---|---|
| 2-123681 | 5/1990 | Japan . |
| 4-29179 | 3/1992 | Japan . |
| 6-48182 | 6/1994 | Japan . |

*Primary Examiner*—Steven L. Stephan
*Assistant Examiner*—Javaid Nasri
*Attorney, Agent, or Firm*—Finnegan, Henderson, Farabow, Garrett & Dunner, L.L.P.

[57] ABSTRACT

According to a connector engaging structure of this invention, first add second connectors are mutually fitted to with each other of separated from each other by pivoting an operation lever. The operation lever is pivotably supported by a housing of the first connector through a supporting shaft. An engaging protrusion is provided on a front face of the housing. An engaging hole for engaging with or disengaging from the engaging protrusion is provided on a first side wall of the operation lever opposing the engaging protrusion. A gap is formed between a rear face of the housing and a second side wall of the operation lever. When the second side wall of the operation lever is moved toward the rear face of the housing so that the gap is reduced, the engaging state between the engaging protrusion and engaging hole can be released. Therefore, it is possible to prevent an error releasing of the engagement of the operation lever with such a simple structure and release the operation lever engaging state easily when it is necessary.

5 Claims, 10 Drawing Sheets

CONNECTOR ENGAGING STRUCTURE

BACKGROUND OF THE INVENTION

This invention relates to a connector engaging structure for engaging or disengaging multi-pole female and male connectors by a small operating force produced by a pivoting action (lever action) of an operation lever and more particularly to an engaging and disengaging structure between a housing and an operation lever for use in the connector engaging structure.

FIGS. 1A, 1B show a first conventional example disclosed in Japanese Unexamined Patent Application No. Hei2-123681.

A cover member 58 is set on a connector housing 50. Cam protrusions 57 of a female connector 56 provided under the cover member 58 are inserted into each of notches 52*a* of a fixing member 52 and each of cam grooves 51*b* of a movable member 51. When the cam protrusions 57 move along the cam grooves 51*b*, the cover member 58 moves toward the fixing member 52. When an operation lever 54 is turned downward, the movable member 51 is moved horizontally and at the same time, the cover member 58 and the female connector 56 are moved downward toward the fixing member 52, so that a multi-pole connector (not shown) of the male connector in the connector housing 50 is mutually fitted to a multi-pole connector (not shown) of the female connector 56 of the cover member 58. As shown in FIG. 1B, when the pivoting of the operation lever 54 is finished, each of engaging convex portions 54*b* of a U-shaped front end portion 54*a* of the operation lever 54 and each of engaging protrusions 59 of the cover member 58 are engaged with each other.

When the multi-pole connectors of the male connector and the female connector 56 are separated from each other, while bringing up the cover member 58, the U-shaped front end portion 54*a* of the operation lever 54 is pressed toward a proximal end of the operation lever 54, so that this portion is elastically deformed. As a result, the locking condition between each of engaging convex portions 54b of the U-shaped front end portion 54*a* of the operation lever 54 and each of engaging protrusions 59 of the cover member 58 is released so that the multi-pole connectors of the male connector and the female connector 56 are separated from each other.

FIGS. 2A, 2B show a second conventional example disclosed in Japanese Unexamined Patent Application No. Hei6-48182.

When a male connector 60 is inserted into a hood portion 64*a* of a female connector 64 and then an operation lever 66 is turned downward, each of cam receiving pins 61 of the male connector 60 moves along a cam groove 67 of the operation lever 66 so that the multi-pole connector of the male connector 60 and the multi-pole connector of the female connector 64 are mutually engaged with each other. Hook portions 63*a* of an engaging pawl 63 of the male connector 60 are fitted to an inclining portion 68*a* of an engaging portion 68 of the operation lever 66 so that the fitting condition between both the connectors 60, 64 is maintained.

When the fitting condition between both the connectors 60 and 64 is released, as shown by an arrow of FIG. 2B, a finger hook portion 63*b* of the engaging pawl 63 is pressed downward so that an elastic leg portion 62 is elastically deformed. As a result, the engaging pawl 63 is deformed so as to retreat from the inclining portion 68*a* of the engaging portion 68 so that the engaging condition between the engaging pawl 63 and the inclining portion 68*a* is released. Consequently, the multi-pole connectors of the male connector 60 and the female connector 64 are separated from each other.

FIGS. 3A, 3B show a third conventional example disclosed in Japanese Unexamined Patent Application No. Hei4-29179.

When an operation lever 75 supported pivotably by a female connector 73 is turned toward a male connector 70, each of cam receiving pins 71 of the male connector 70 moves along each of eccentric cam grooves 76 of the operation lever 75 so that a multi-pole connector of the male connector 70 and the multi-pole connector 73 of the female connector 73 are mutually fitted to each other. As shown in FIGS. 4A, 4B, 4C, a fitting condition:between the connectors 70 and 73 is attained when an engaging:hole 77 of the operation lever 75 surpasses an engaging protrusion 72 of the male connector 70 and then is fixed by the engaging protrusion 72.

When the fitting condition between both the connectors 70 and 73 is released, both side portions 75*a*, 75*a* of the operation lever 75 are opened using a jig or the like so as to release the engaging condition between the engaging protrusion 72 and the engaging hole 77. As a result, the multi-pole connectors of the male connector 70 and the female connector 73 are separated from each other.

However, the aforementioned conventional examples have the following problems.

In the first conventional example shown in FIGS. 1A, 1B, a locking structure containing the operation lever 54 and engaging protrusion 59 is complicated. The front end portion 54*a* and the like of the operation lever 54 having the engaging convex portion 54*b* are easy to break. Further, only by pressing the front end portion 54*a* of the operation lever 54 toward the proximal And of the operation lever 54 so that it is elastically deformed, the locking condition between the engaging convex portion 54*b* of the operation lever 54 and the engaging protrusion 59 of the cover member 58 is easily released. Thus, possibly the locking of the both members may be released unexpectedly.

In the second conventional example shown as FIGS. 2A, 2B, the locking structure between the engaging pawl 63 of the male connector 60 and the engaging portion 68 of the operation lever 66 is complicated. Further the hook portion 63*a* of the engaging pawl 63 and the inclining portion 68*a* and the like of the engaging portion 68 of the operation lever 66 are easy to break. Further, only by pressing the finger hook portion 63*b* of the engaging pawl 63 downward so as to elastically deform the elastic leg portion 62, the locking condition between the hook portion 63*a* of the engaging portion 63 and the inclining portion 68*a* of the engaging portion 68 is easily released. Thus, possibly the locking condition of the both members may be released unexpectedly.

In the third conventional example shown in FIGS. 3A, 3B, the jig or the like must be used for releasing the locking condition between the engaging protrusion 72 and the engaging hole 77. Thus, the unlocking operation is very complicated, so that a special skill is needed for this procedure.

SUMMARY OF THE INVENTION

An object of the present invention is to provide a connector engaging structure capable of preventing an error releasing of the engagement state of an operation lever with a simple structure and releasing the engagement state of the operation lever by deflecting the operation lever in a predetermined direction.

To achieve the above object, according to a first aspect of the present invention, there is provided a connector engaging structure, comprising:

a first connector;

a housing for supporting the first connector, the housing having a first face and a second face;

a second connector capable of being fitted to the first connector;

an operation lever pivotably connected to the housing such that it is movable in a first direction and a second direction in opposite to each other, the operation lever having a first side wall and a second side wall in opposite to each other, the second connector being moved toward the housing when the operation lever is moved in the first direction so that the connectors are fitted to each other, the second connector being moved apart from the housing when the operation lever is moved in the second direction so that the connectors are separated from each other, the first and second side walls of the operation lever moved in the first direction opposing the first and second faces of the housing:

a first engaging portion disposed on the first face of the housing;

a second engaging portion engageable with the first engaging portion, the second engaging portion being disposed on the first side wall of the operation lever, the first and second engaging portions being mutually engaged with each other so as to attain a locking state when the operation lever is moved in the first direction so that the connectors are fitted to each other, a fitting state between the connectors being maintained when the first and second engaging portions are in the locking state; and a gap formed between the second face and the second side wall in the locking state, the gap allowing the second side wall to move toward the second face in the locking state, the first side wall being deflected in a direction to leave the first face when the second side wall moves toward the second face so as to decrease the gap, thereby making it possible to release an engagement between the first engaging portion and the second engaging portion.

One and the other of the first and the second connectors may be a female type multi-pole connector and a male type multi-pole connector respectively.

One and the other of the first and the second engaging portions may be formed in the shape of a protrusion and a hole respectively.

According to the first aspect of the invention, the first and the second connectors are fitted to each other or separated from each other by a low operating force of the operation lever. The engaging structure and the disengaging structure between the housing and the operation lever can be formed with a simple Structure. As a result, the housing and operation lever are engaged with each other securely. The engaging state between the housing and the operation lever can be released easily by pressing the second side wall of the operation lever toward the second face of the housing so as to move the operation lever in the second direction.

According to a;second aspect of the present invention, there is provided a connector engaging structure according to the first aspect wherein the operation lever is formed in a substantially U-shape having a flat plate portion and the first and second side walls extending from both sides of the flat plate portion in substantially same directions, the second side wall has a tapered face opposing the second face of the housing, and the gap is formed between the tapered face and the second face.

According to the second aspect of the invention, only by forming the tapered face on the second side wall of the operation lever, the disengaging structure between the housing and the operation lever can be obtained. Thus, the disengaging structure Is formed with a very simple structure. Consequently, a simple engaging structure unlikely to be broken is achieved at a low cost.

According to a third aspect of the present invention, there is provided a connector engaging structure according to the first aspect, wherein the housing and the operation lever are formed of synthetic resin, the first side wall of the operation lever is capable of being elastically deformed toward the second face of the housing, and the housing has a rib projecting from the second face in the vicinity of a front end of the operation lever without interfering with the operation lever.

According to the third aspect of the invention, the operation lever is protected by the rib and the error release of the engagement state between the housing and the operation lever is prevented securely.

DESCRIPTION OF THE PREFERRED EMBODIMENTS

Hereinafter, an embodiment of the present invention will be described with reference to the accompanying drawings.

Figure 1A:
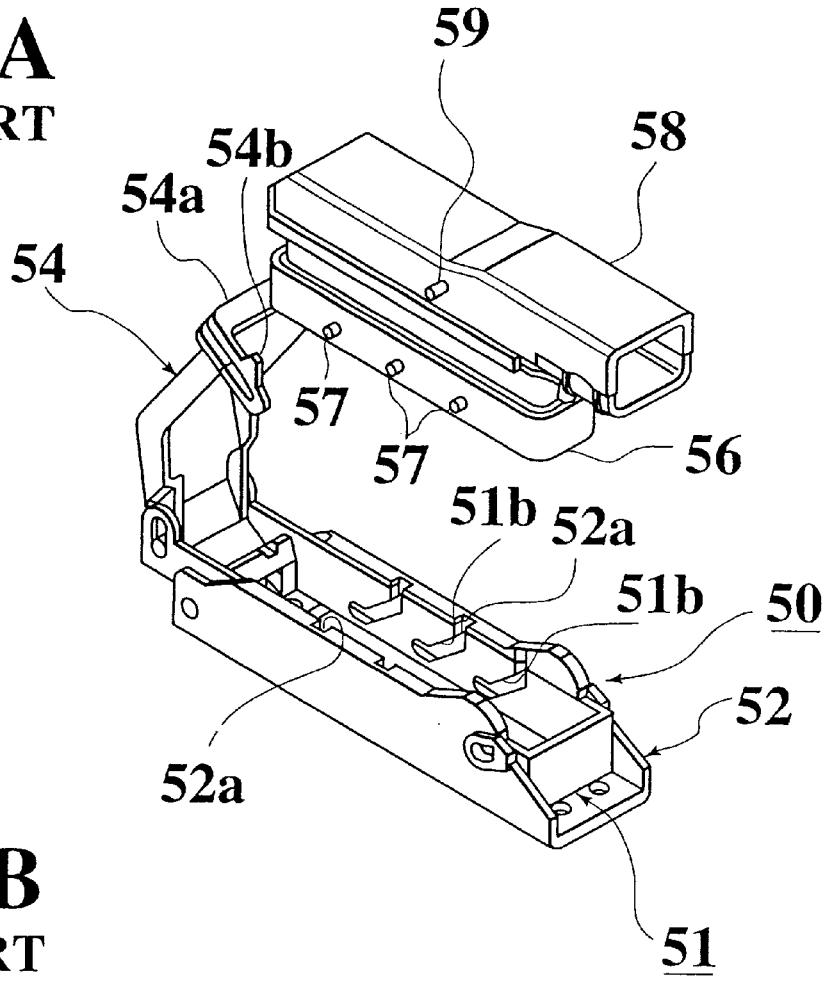
FIG.1A PRIOR ART
FIG. 1A is a perspective view showing a state before fitting connectors according to a first conventional example.
Figure 1B:
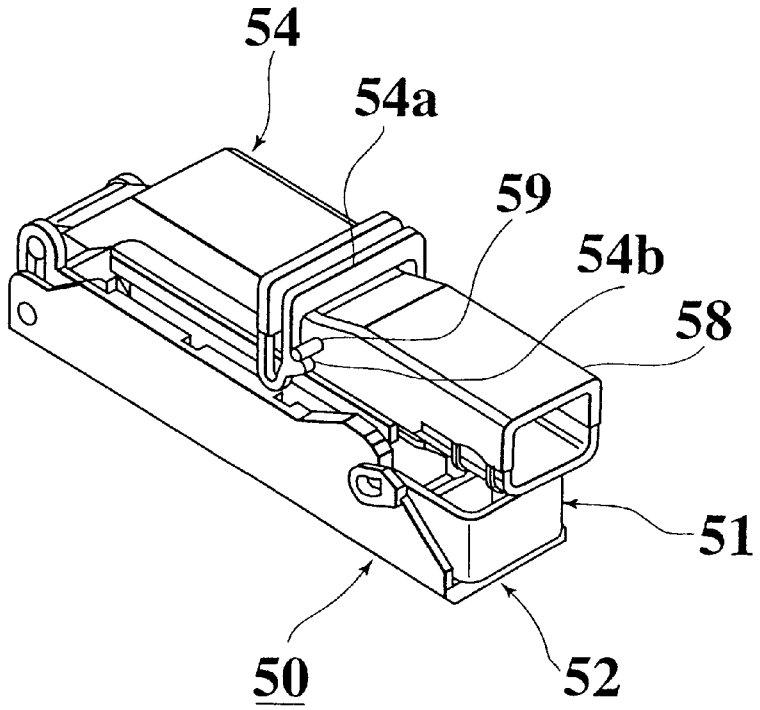
FIG.1B PRIOR ART
FIG. 1B is a perspective view showing a state after fitting connectors according to the first conventional example.
Figure 2A:
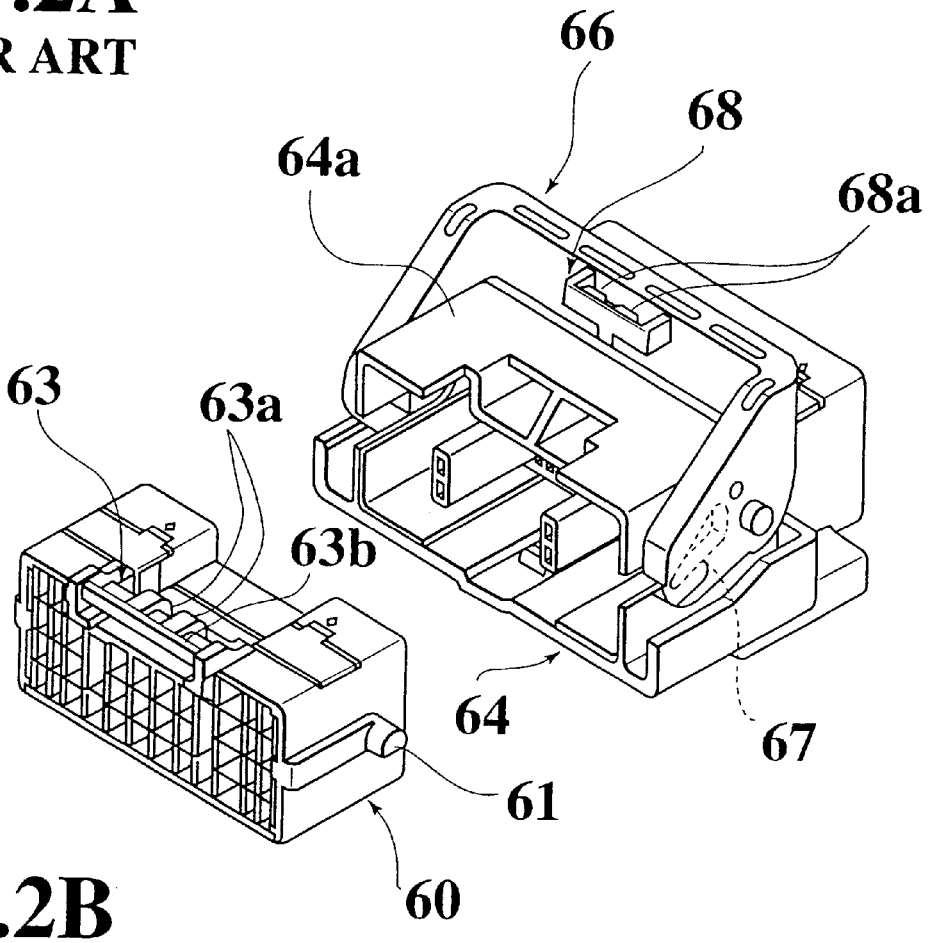
FIG.2A PRIOR ART
FIG. 2A is a perspective view showing a state before fitting connectors according to a second conventional example.
Figure 2B:
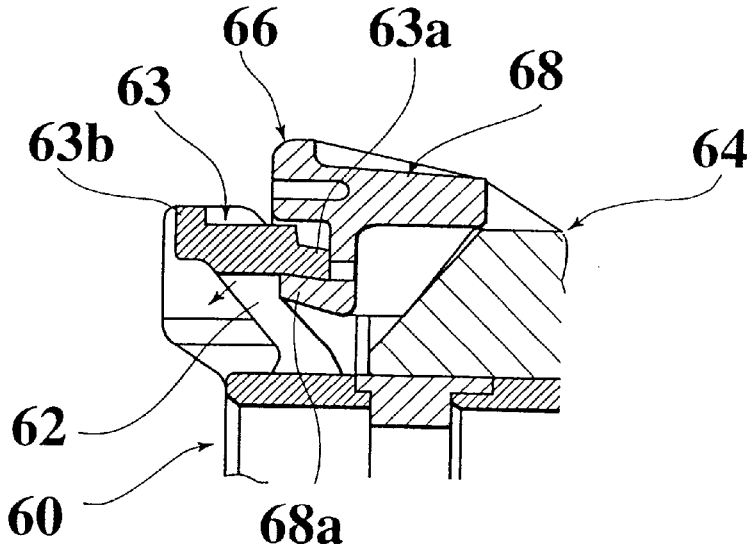
FIG.2B PRIOR ART
FIG. 2B is a perspective view showing a state after fitting connectors According to the second conventional example.
Figure 3A:
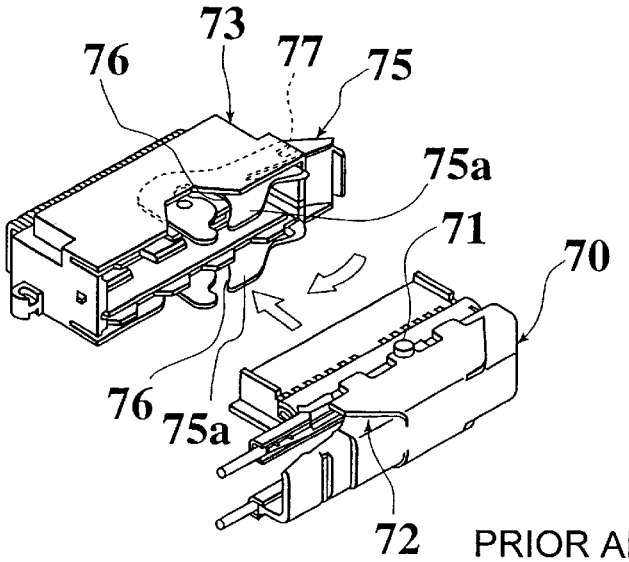
PRIOR ART FIG.3A
FIG. 3A is a perspective view showing a state before fitting connectors according to a third conventional example.
Figure 4A:
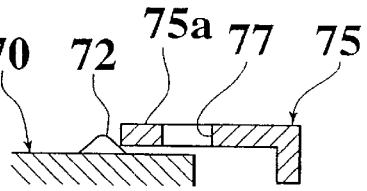
PRIOR ART FIG.4A
FIG. 4A is a sectional view showing a state before engaging an engaging protrusion and an engaging hole of an operation lever with:each other according to the third conventional example.
Figure 3B:
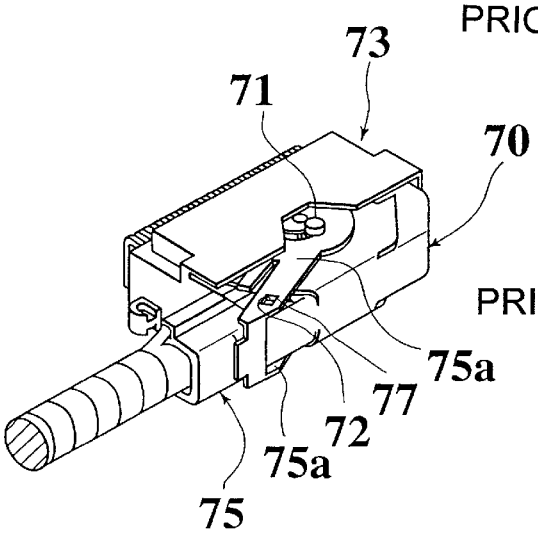
PRIOR ART FIG.3B
FIG. 3B is a perspective view showing a state after fitting connectors according to the third conventional example.
Figure 4B:
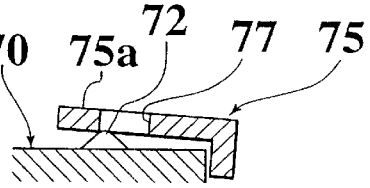
PRIOR ART FIG.4B
FIG. 4B is a sectional view showing a state during an operation of engaging the engaging protrusion and the engaging hole of the operation lever according to the third conventional example.
Figure 4C:
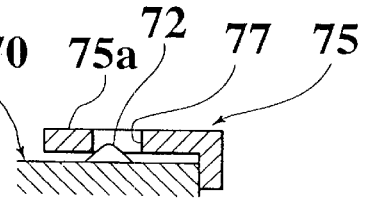
PRIOR ART FIG.4C
FIG. 4C is a sectional view showing a state after engaging the engaging protrusion and the engaging hole of the operation lever with each other according to the third conventional example.
Figure 5:
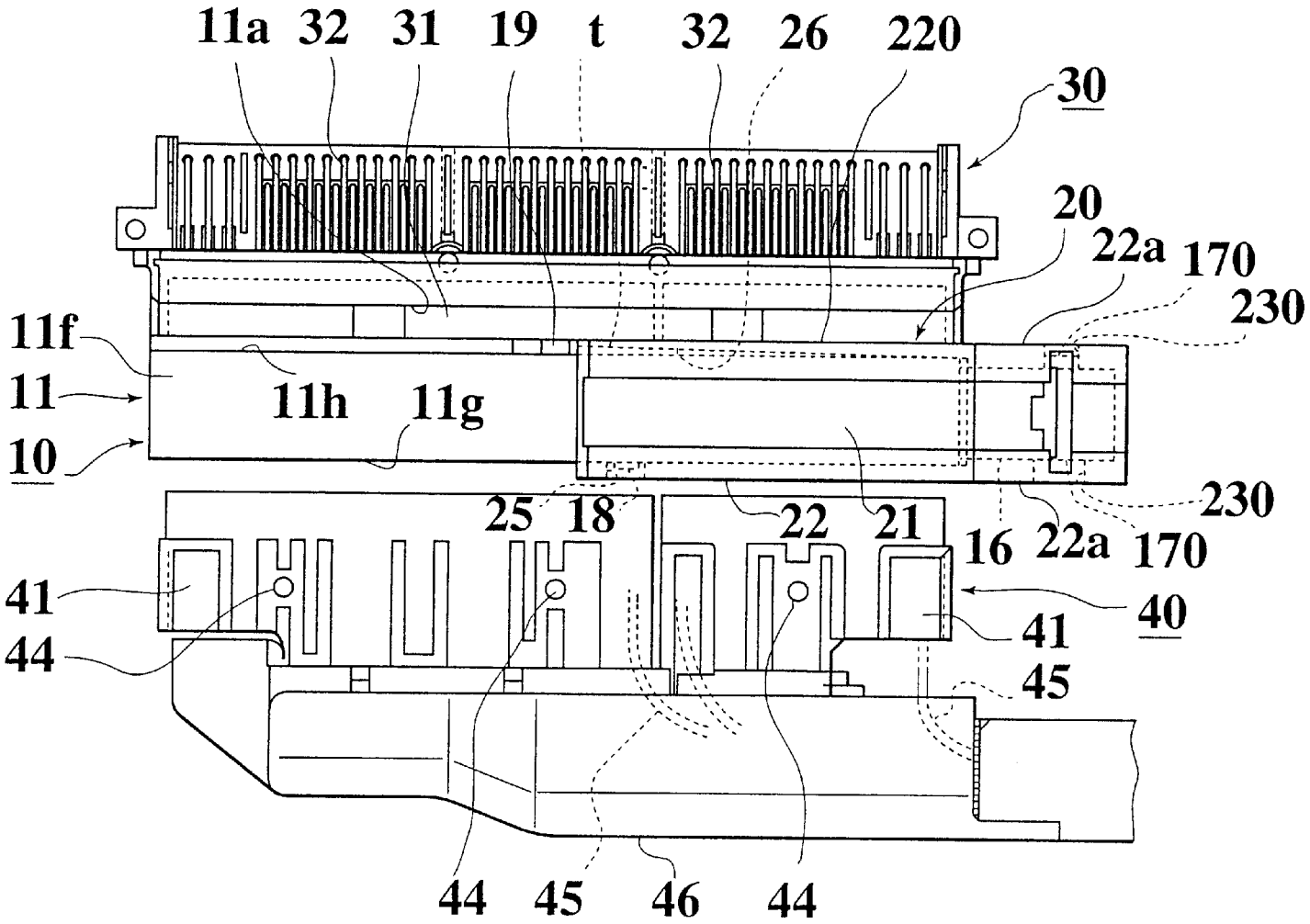
FIG. 5 is a plan view showing a state before engaging female and the male connectors having the connector engaging structure according to an embodiment of the present invention.
Figure 6:
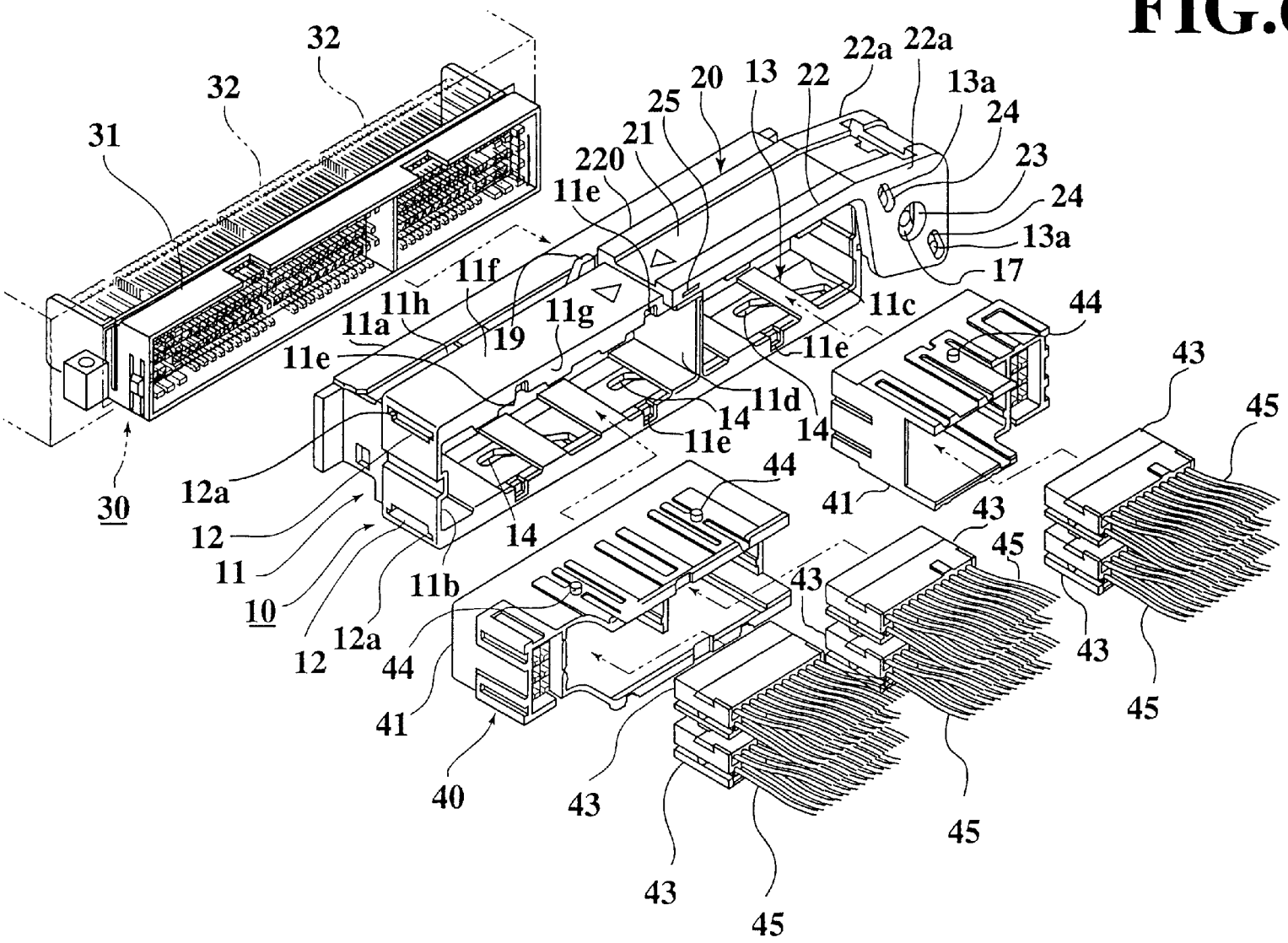
FIG. 6 is an exploded perspective view of the female and male connectors of FIG. 5.
Figure 7:
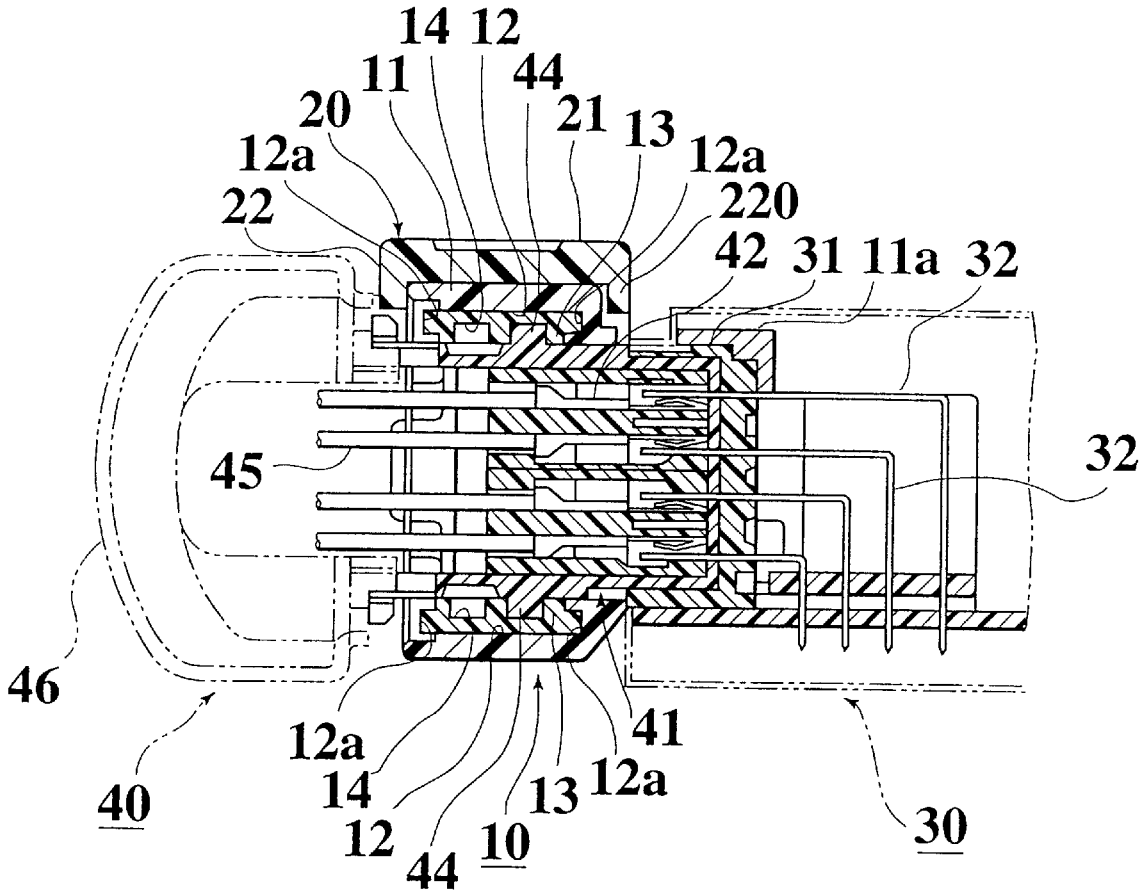
FIG. 7 is a sectional view showing an engaging state between the female and the male connectors of FIG. 5.

FIG. 5 is a plan view showing a state in which female and male connectors having a connector engaging structure according to an embodiment of the present invention are separated. FIG. 6 is an exploded perspective view of the female and the male connectors and FIG. 7 is a sectional view showing a state in which the females and the male connectors are fitted to each other.

The connector engaging structure comprises a female connector (first multi-pole connector) 30, a male connector (second multi-pole connector) 40 and a hood assy 10. The hood assy 10 comprises a square pole hood 11 made of synthetic resin which acts as a housing of the female connector 30, a pair of slide members 13, 13 made of synthetic resin and an operation lever made of synthetic resin 20.

The female connector 30 is fitted into and fixed to an opening portion 11*a* of the back side of the hood 11. The male connector 40 is inserted into an opening portion 11*b* of the front side of the hood 11. A pair of slide grooves (sliding portion) 12, 12 up/down are formed on a vertical wall of the front side of the hoed 11. A pair of insertion holes 11*c* 11*c* are formed on the up and down positions of one side wall of the hood 11. Slide members 13, 13 are inserted into slide grooves 12, 12 from the insertion holes 11*c*, 11*c* so that the slide members 13, 13 elide along the slide grooves 12, 12 in reciprocation. The operation lever 20 slides each of the slide members 13 In reciprocation so as to fit/remove the multi-pole female connector 30 to/from the male connector 40.

Figure 8:
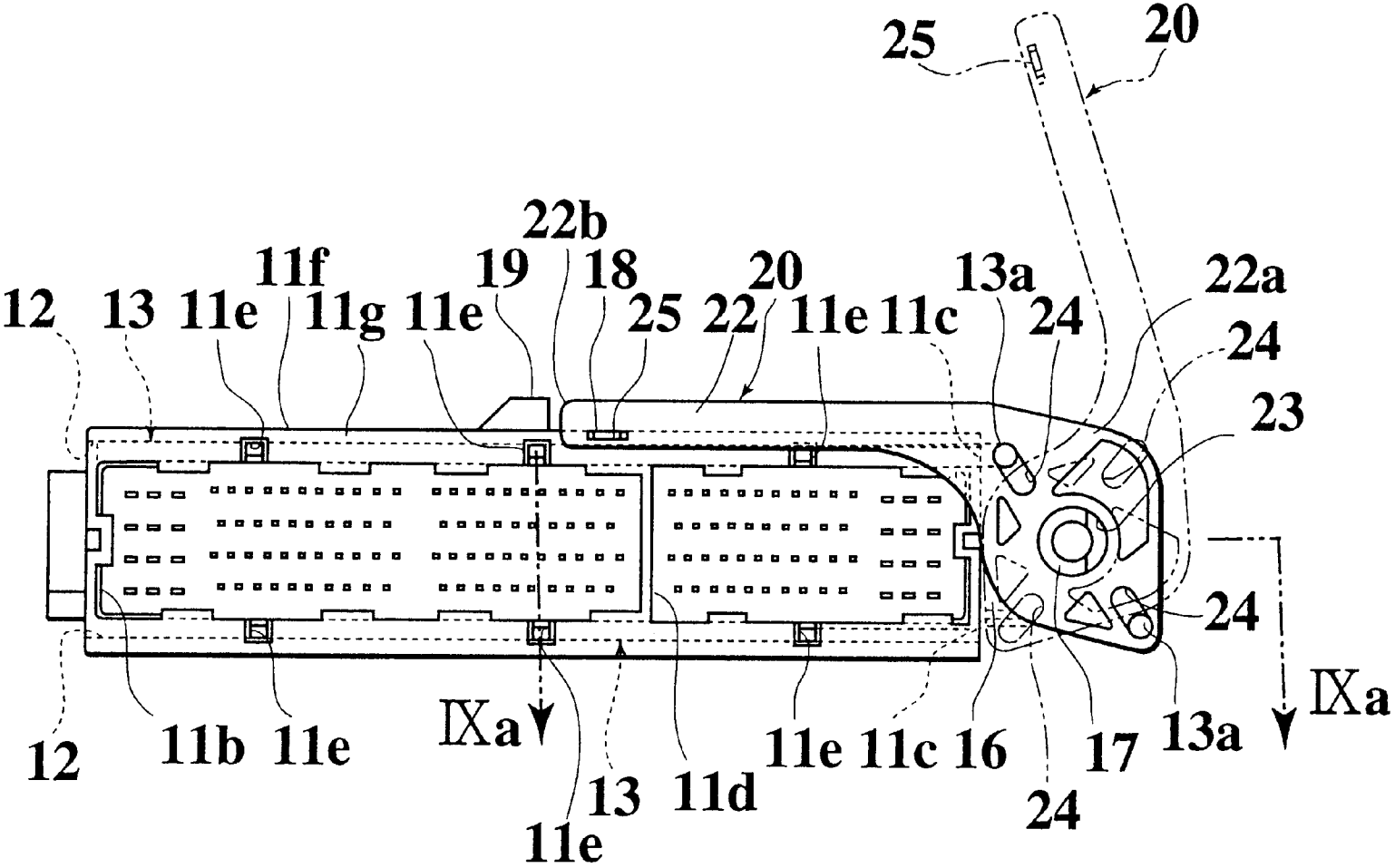
FIG. 8 is a front view of the female connector of FIG. 5.

As shown in FIGS. 6, 8, an opening portion 11*b* of the front side of the hood 11 is divided to two male connector accommodating chambers by a partition wall 11*d*. As shown in FIGS. 6, 7, a step portion 12*a* for holding a thin portion on both edges of the slide member 13 are formed in each of slide grooves 12. A pair of the slide members 13, 13 slide in opposite directions to each other along the pair of the slide grooves 12, 12 in reciprocation. As shown in FIGS. 6, 8, cutouts 11*e* are formed on the up/down edges of the front side of the hood 11. Each of the cutouts 11*e* is disposed at a position corresponding to an introduction groove 14*a* of each of guide grooves 14.

Figure 11A:
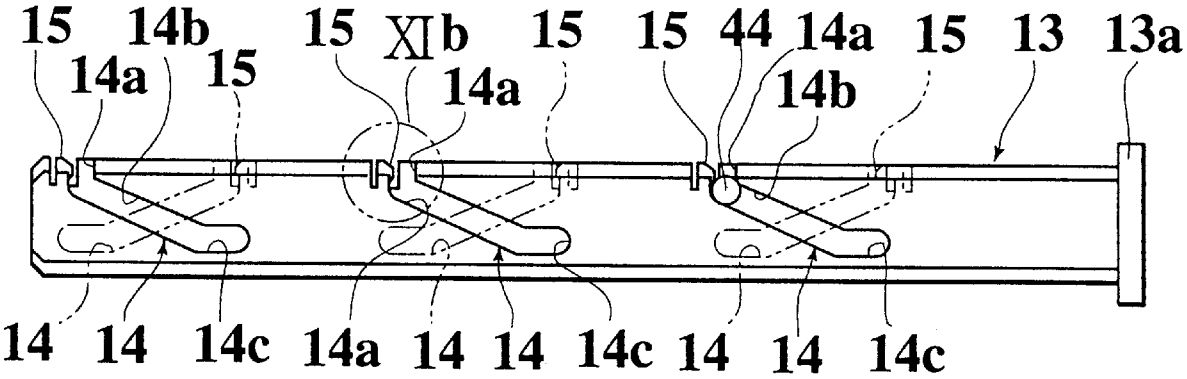
FIG. 11A is an explanatory view of slide members to be provided on the female connector, viewed from the side of the guide grooves.
Figure 11B:
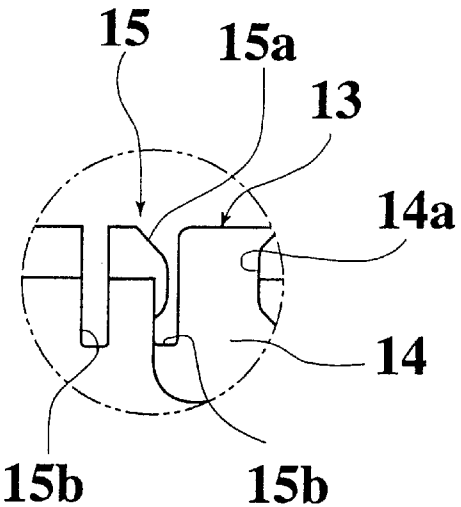
FIG. 11B is an enlarged explanatory view of a portion XIb of FIG. 11A.

Three guide grooves 14 inclined at a predetermined angle relative to the insertion direction of each of slide members 13 are formed on mutually opposing faces of the pair of the slide members 13, 13. As shown by a solid line and a dot and dash line of FIG. 11A, the inclining directions of each of the guide grooves 14 of the upper slide member 13 and the lower slide member 13 are opposite to each other. Each of the guide grooves 14 includes an introduction groove 14*a* which is open to a side edge (upper edge of FIG. 11A) and substantially perpendicular to the side edge, an inclined groove 14*b* which is continuous from the introduction groove 14*a* and a terminating groove 14*c* which is continuous from this inclined groove 14*b* and parallel to the length direction of the slide member 13. As shown in FIG. 11B, on one side of the introduction groove 14*a* which acts as an entrance portion for a guide pin 44 which will be described later of each guide groove 14 is provided a temporary engaging means 15 which temporarily engages to the guide pin 44. The temporary engaging means 15 includes a flexible protrusion 15*a* which is integrally projected so as to be parallel to the introduction groove 14*a* of the guide groove 14 and a pair of cutouts 15*b*, 15*b* provided on both sides of the flexible protrusion 15*a*.

As shown in FIG. 5–10, the operation lever 20 is formed in a substantially U shape having a flat plate portion 21 and both side walls 22, 220 extending downward along the both sides of the flat plate portion 21. Each of base portions 22*a* of both side walls 22, 220 is formed in a substantially diamond shape. Large and small rotation center holes 23, 230 are formed on the both side walls 22, 220. In the large and small rotation center holes 23, 230 are inserted large/small diameter supporting shafts 17, 170 provided on both sides of a lever mounting portion 16 formed so as to project between the pair of the insertion holes 11*c*, 11*c* on one side wall of the hood 11. The operation lever 20 is supported through the supporting shafts 17, 170 such that it is pivotable vertically in FIG. 8. A pair of oval holes 24, 24 are formed such that they sandwich each of the rotation center holes 23, 230, on corner portions mutually opposing of each base portion 22*a* of the both side walls 22, 220 of the operation lever 20. In each of the pair of the oval holes 24, 24 is inserted each of cylindrical mounting protrusions 13*a* of the pair of the slide members 13, 13 up and down. When the operation lever 20 is pivoted In the vertical direction, the pair of the slide members 13, 13 up and down slide in mutually opposite directions to each other in reciprocation.

As shown in FIGS. 5–8, an inside face of the flat plate portion 21 of the operation lever 20 is formed so as to be relatively wider than a top face 11*f* of a top wall of the front side of the hood (housing) 11. The both side walls 22, 220 of the operation lever 20 project downward such that they sandwich a front face 11*g* and a rear face 11*h* of the top wall of the front side of the hood 11. Each of front end portions 22*b* of the both side walls 22, 220 reaches a substantially center of the top face 11f of the top wall of the front side of the hood 11. A rectangular engaging hole (engaging portion) 25 is formed on the front end portion 22*b* of the side wall 22 of one side (side of the front face 11*g* of the hood 11) of the both side walls 22, 220 of the operation lever 20. On the front face 11*g* (one side) of the front side of the hood 11 opposing the engaging hole 25 is formed integrally an engaging protrusion (engaging portion) 18 which is engaged with or disengaged from the engaging hole 25.

Figure 9A:
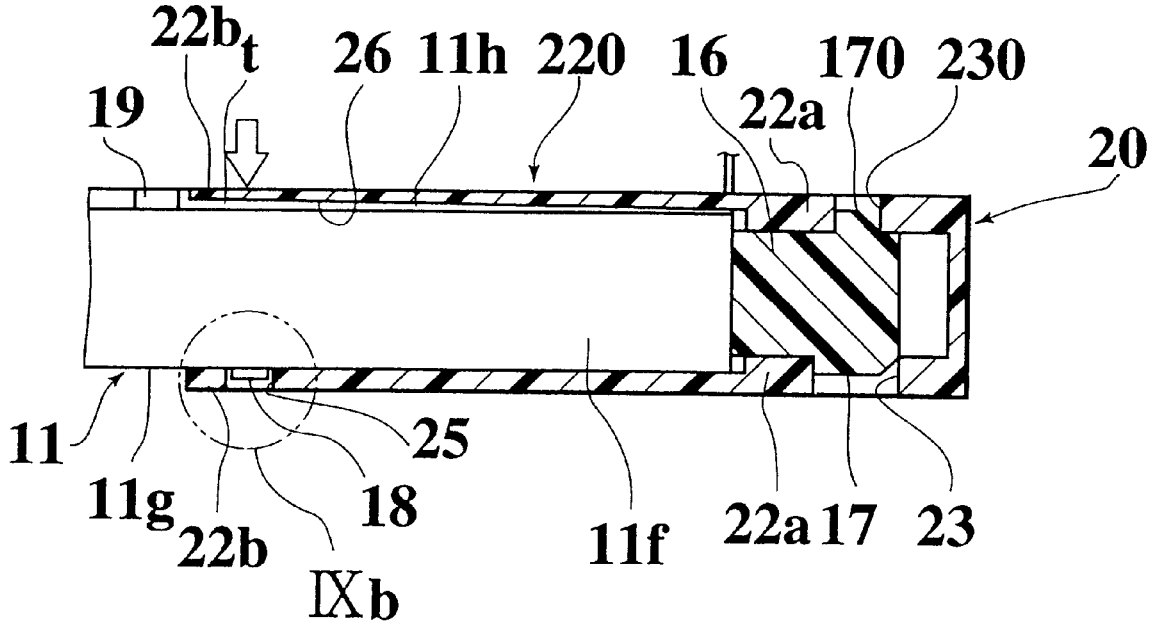
FIG. 9A is a sectional view taken along the line IXa—IXa of FIG. 8.
Figure 9B:
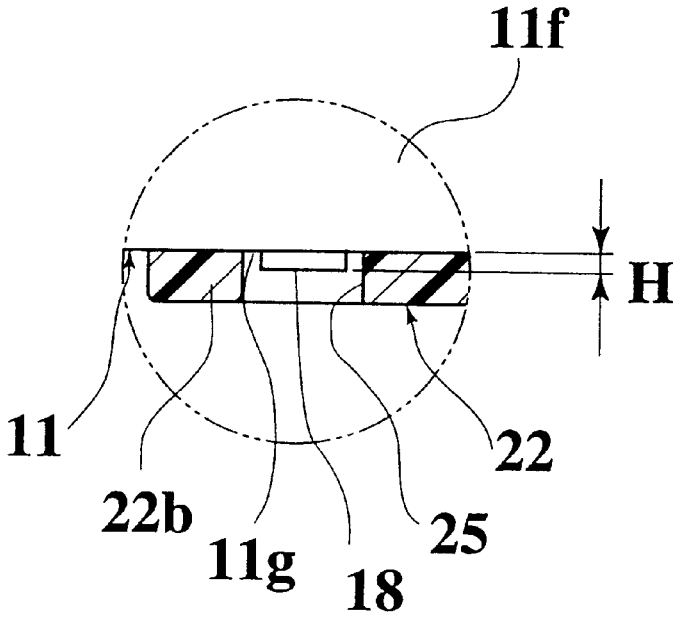
FIG. 9B is an enlarged sectional view of a portion IXb of FIG. 9A
Figure 10A:
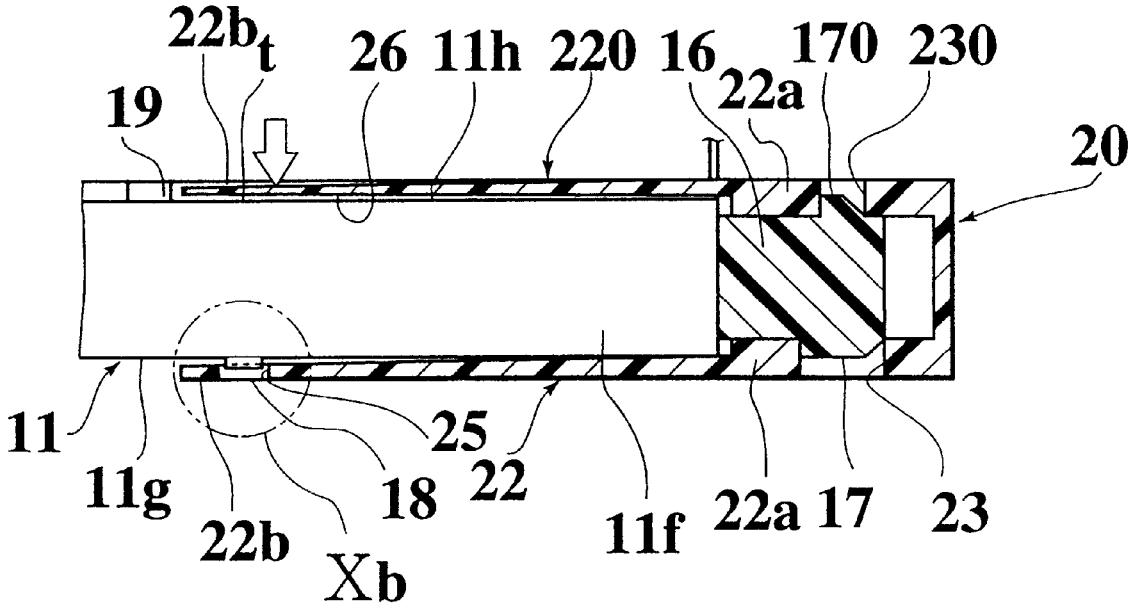
FIG. 10A is a sectional view showing a state in which an engagement between an engaging hole of the operation lever attached to a hood of the female connector and an engaging protrusion of the hood is released.
Figure 10B:
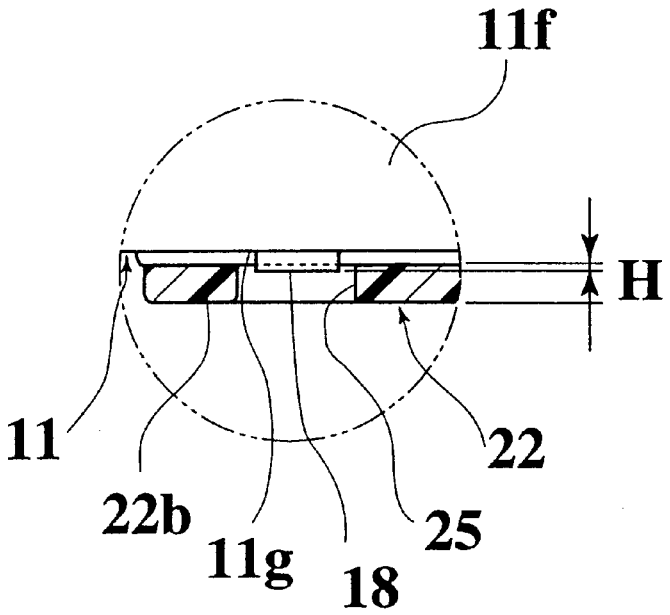
FIG. 10B is an enlarged sectional view of a portion Xb of FIG. 10A.

As shown in FIGS. 5, 9, 10, a tapered face 26 is formed on a face of the side wall 220 of the other side of the both side walls 22, 220 of the operation lever 20, opposing the rear face (the other face) of the top wall of the front side of the hood 11. A gap t is formed between the tapered face 26 and the rear face 11*h* of the hood 11. The gap t is set so that the width thereof increases as it approaches the front end portion 22*b* of the other side wall 220. When the other side wall 22' of the operation lever 20 is deflected in the direction of the rear face 11*h* of the hood 11 (elastic deformation) so that the gap t is decreased, the engaging condition between the engaging protrusion 18 of the hood 11 and the engaging hole 25 of one side wall 22 of the operation lever 20 is easily released. A size (width) of the engaging portion between the engaging protrusion 18 and the engaging hole 25 before the other side wall 220 of the operation lever is deformed is indicated by H of FIG. 9B. The size (width) of the engaging portion between the engaging protrusion 18 and the engaging hole 25 after the other side wall 220 of the operation lever 20 is deformed is indicated by L(H>L) of FIG. 10B. Further, on the rear face 11*h* of the hood 11 is formed a rib 19 for protecting the lever and preventing an error release integrally so as to project. The rib 19 is disposed in the vicinity of the front end portion 22*b* of the other side wall 220 of the operation lever 20.

As shown in FIGS. 5–7, a frame portion 31 on the front side of the female connector 30 is fitted into and fixed to the opening portion 11*a* on the rear side of the hood 11. A plurality of pin terminals 32 are projected from the frame portion 31 to the opening portion 11*a* of the rear portion of the hood 11. Into the opening portion 11*b* on the front side of the hood 11 are inserted a pair of the connector housings 41, 41 of the male connector 40 in the direction perpendicular to a traveling direction of each of slide members 13. Each of pin terminals 32 are inserted into each of connector housings 41 of the male connector 40. In each of connector housings 41 is accommodated each of connector main bodies 43 containing a plurality of terminals 42 for electrically connecting both the connectors 30 and 40 with each other. Three guide pins 44 are integrally formed on each of the upper and lower surfaces of each of connector housings 41 so that they are projected. The guide pin 44 is inserted into each of cutouts 11*e* of the hood 11 when both the connectors 30, 40 are mutually fitted to each other and then inserted into the guide groove 14 of each slide member 13 such that it Is movable therein. A wire 45 is connected to each terminal 42. The wires 45 and the like exposed out of each of connector main bodies 43 of the male connector 40 are covered with a cover 46.

According to the engaging structure of the connector of the present embodiment, as shown in FIG. 5, with the hood assy 10 being mounted on the female connector 30, the male connector 40 is inserted into the hood 11 from an opposite side to the female connector 30. Then, each of guide pins 44 of the male connector 40 is passed through each of cutouts 11*e* of the hood 11 and taken into the introduction groove 14*a* of the guide groove 14 of each of slide members 13. When the operation lever 20 is operated downward, each of slide members 13 slides in each of the slide grooves 12 of the hood 11 in reciprocation. As a result, each guide pin 44 moves from the introduction groove 14*e* of each of guide grooves 14 through the inclined groove 14*b* and finally reaches the terminating groove 14*c*. The male connectors 40 are pulled into the hood 11 so that both the connectors 30, 40 are mutually fitted to each Other. Further, when the operation lever 20 is operated upward, the respective slide members 13 slide in the respective slide grooves 12 in a return direction. As a result, each guide pin 34 moves from the terminating groove 14*c* of each of guide grooves 14 through the inclined groove 14*b* up to the introduction groove 14*a*, so that the male connectors 40 leave the hood 11 thereby both the connectors 30, 40 being separated. At this time, because of a lever ratio of the operation lever 20 and decomposition of a force by an inclining angle of the inclined groove 14*b* of each of guide grooves 14, the multi-pole male and female connectors 30, 40 can be fitted to each other or separated from each other at a low operating force of the operation lever 20 accurately and smoothly.

The fitting state between the multi-pole female connector 30 and male connector 40 is securely locked because the engaging hole 25 of one side wall 22 of the operation lever 20 is engaged with the engaging protrusion 18 of the front side 11*g* of the hood 11 as shown in FIGS. 9A, 9B when the downward turning of the operation lever 20 is finished.

When the multi-pole female connector 30 and male connector 40 are separated from each other, as shown by arrows in FIGS. 9A, 10A, the other side wall 220 of the operation lever 20 is pressed so as to be elastically deformed toward the rear face 11*h* of the hood 11 so that the gap t between the tapered face 26 and the rear face 11 of the hood 11 is reduced. As a result, the size of the engaging portion between the engaging protrusion 18 of the hood 11 and the engaging hole 25 of the operation lever 20 decreases from H to L, so that both the members become likely to be released from each other. That is, in a condition in which the side wall 220 of the operation lever 20 is not pressed toward the rear face 11*h* of the hood 11, as shown in FIG. 9B, the operation lever 20 cannot be unlocked because the size H of the engaging portion between the engaging protrusion 18 of the hood 11 and the engaging hole 25 of the operation lever 20 is large. On the contrary, in a condition in which the other side wall 220 of the operation lever 20 is pressed toward the rear face 11*h* of the hood 11 so that it is deflected, the operation lever 20 can be easily unlocked because the size L of the engaging portion between the engaging protrusion 18 of the hood 11 and the engaging hole 25 of the operation lever 20 is small, as shown in FIG. 10B. For the reason, it is possible to prevent the multi-pole female, connector 30 and male connector 40 from being separated from each other by ordinary user except manufacturers or repairers. Further, it is possible to simplify the engaging structure and disengaging structure between the hood 11 and the operation lever 20, so as to facilitate production of molding dies thereby reducing production cost and preventing a breaking of the structures when the connectors are fitted.

As described above, the engaging structure and disengaging structure between the hood 11 and operation lever 20 are simple, they cannot be disengaged easily if the disengaging method is not known. Further, the rib 19 provided on the rear face 11*h* of the hood 11 such that it projects ahead of the front end of the operation lever 20 protects the operation lever 20 securely and provides a structure in which ordinary user cannot release the locking state between the engaging protrusion 18 of the hood 11 and the engaging hole 25 of the operation lever 20 intentionally or by mistake.

Although according to the aforementioned embodiment, the engaging protrusion is provided on the hood (housing) side while the engaging hole is provided on the operation lever, it is permissible to provide the engaging hole on the hood and engaging protrusion on the operation lever. Further, although the slide members having the guide grooves are provided on the female connector and the guide pins for engaging with the guide grooves are provided on the male connector, it is permissible to provide the guide pins on the female connector and the slide members on the male connector.

What is claimed is:

1. A connector engaging structure, comprising:

a first connector;

a housing for supporting the first connector, the housing having a first face and a second face;

a second connector capable of being fitted to the first connector;

an operation lever pivotably connected to the housing such that it is movable in a first direction and a second direction in opposite to each other, the operation lever having a first side wall and a second side wall in opposite to each other, the second connector being moved toward the housing when the operation lever is moved in the first direction so that the connectors are fitted to each other, the second connector being moved apart from the housing when the operation lever is moved in the second direction so that the connectors are separated from each other, the first and second side walls of the operation lever moved in the first direction opposing the first and second faces of the housing;

a first engaging, portion disposed on the first face of the housing;

a second engaging portion engageable with the first engaging portion, the second engaging portion being disposed on the first side wall of the operation lever, the first and second engaging portions being mutually engaged with each other so as to attain a locking state when the operation lever is moved in the first direction so that the connectors are fitted to each other, a fitting state between the connectors being maintained when the first and second engaging portions are in the locking state; and a gap formed between the second face and the second side wall in the locking state, the gap allowing the second side wall to move toward the second face in the locking state, the first side wall being deflected in a direction to leave the first face when the second side wall moves toward the second face so as to decrease the gap, thereby making it possible to release an engagement between the first engaging portion and the second engaging portion.

2. The connector engaging structure according to claim 1, wherein the operation lever is formed in a substantially U-shape having a flat plate portion and the first and second side walls extending from both sides of the flat plate portion in substantially same directions, the second side wall has a tapered face opposing the second face of the housing, and the gap is formed between the tapered face and the second face.

3. The connector engaging structure according to claim 1, wherein the housing and the operation lever are formed of synthetic resin, the first side wall of the operation lever is capable of being elastically deformed toward the second face of the housing, and the housing has a rib projecting from the second face in the vicinity of a front end of the operation lever without interfering with the operation lever.

4. The connector engaging structure according to claim 1, wherein one of the first and second connectors is a female type multi-pole connector, and the other of the first and second connectors is a male type multi-pole connector.

5. The connector engaging structure according to claim 1, wherein one of the first and second engaging portions is formed in the shape of a protrusion, and the other one of the first and second engaging portions is formed in the shape of a hole.

* * * * *